US005094417A

United States Patent [19]

Creed

[11] Patent Number: 5,094,417

[45] Date of Patent: Mar. 10, 1992

[54] HANDBAG ADAPTABLE SUPPORT

[76] Inventor: Kenny D. Creed, Box 198(a), Rte. 1, Moberly, Mo. 65270

[21] Appl. No.: 621,529

[22] Filed: Dec. 3, 1990

[51] Int. Cl.[5] ..... A47F 5/00

[52] U.S. Cl. ..... 248/215; 248/308; 248/339; 248/914

[58] Field of Search ..... 298/205.1, 914, 690, 298/691, 214, 215, 227, 304, 305, 308, 324, 339, 340; D3/54; D8/367, 373; 24/343, 370

[56] References Cited

U.S. PATENT DOCUMENTS

| | | | |
|---|---|---|---|
| D. 159,834 | 8/1950 | Meyer | D8/373 |
| D. 256,738 | 9/1980 | Dockery | D3/54 |
| D. 263,779 | 4/1982 | Valli | D8/367 |
| D. 297,074 | 8/1988 | Burke | D3/54 |
| 1,132,414 | 3/1915 | White | 248/217.1 |
| 1,751,198 | 3/1930 | Franck | 248/215 |
| 2,064,133 | 12/1936 | Von Schroeder | 248/215 |
| 2,188,701 | 1/1940 | Brullhardt | 248/215 |
| 2,473,086 | 6/1949 | Montero | 248/914 |
| 2,521,037 | 9/1950 | Brinton | 248/339 |
| 2,532,255 | 11/1950 | Davis | 248/914 |
| 2,565,719 | 8/1951 | Church | 248/215 |
| 3,376,006 | 4/1968 | Zezula | 248/339 |
| 3,461,071 | 2/1969 | Mettenleiter | 24/343 |
| 3,630,475 | 12/1971 | Barry | 248/914 |
| 3,860,210 | 1/1975 | Berardinella | 248/308 |
| 4,194,714 | 3/1980 | Schultz | 248/215 |
| 4,210,302 | 7/1980 | Serkez | 248/914 |
| 4,312,455 | 1/1982 | Weber | 248/914 |

*Primary Examiner*—David M. Purol
*Assistant Examiner*—Robert A. Olson
*Attorney, Agent, or Firm*—Thomas M. Scofield

[57] ABSTRACT

Improvements in devices for receiving, hanging and supporting purses, handbags and other strap carried containers on the edge of a table, desk or other support; portable hanger devices for purses, handbags and the like able to engage the periphery of a table, desk or other support and receive therewithin the straps of a purse or handbag in such a manner as to support it in at least two optional positions, thus enabling free support of the container, handbag or purse in either crowded or open conditions around the table or desk.

2 Claims, 2 Drawing Sheets

HANDBAG ADAPTABLE SUPPORT

BACKGROUND OF THE INVENTION

It is well known to provide a handbag or purse holder for use by the user or owner of such when they sit down at a table or desk. In the Prior Art section herein listed, there are seen quite a number of devices devised for such application and use. The rationale of such devices is that first, in many instances, there may not be sufficient space on a table or desk at which the owner sits (perhaps with several others, each also with a purse) to put or set the purse or handbag on the table or desk surface. This may be from the small size of the table or desk or the fact that the surface thereof is already well covered with materials and articles or both. Secondly, the owner or user of the purse or handbag does not want to put the receptacle or container on the floor, perhaps for several reasons. One would be not to soil or damage the purse or handbag. Secondly, a purse or handbag on the floor may be displaced under the table or desk or a chair and get lost or be forgotten. Still further, a floorborne purse or handbag is vulnerable to theft.

A holder of this type must be sufficiently small in size that it is not cumbersome or heavy, this feature also involving the materials of the device is made. It would be best if such device were small enough to be received inside a handbag, when desired and, further, have means for attachment to the strap or one of the straps of a purse or handbag when it is desired to be carried externally.

Optimally, such device would be so constructed as to be able to receive the strap or straps of more than one handbag (so that a friend's handbag can also perhaps be suspended from the same device) and further have versatility with respect to how the purse or handbag is hung with respect to the supporting table, desk or the like. Thus, the bag should be optionally suspendable at right angles to the supporting edge of the desk or tables, table or parallel thereto. Further, it would be best if the device, in addition to having open legs and hooks on which to hang the bag and purse straps, also has a closeable such hook for greater security.

Another place where a handbag or purse may be held, in absence of a device of this type, is in the lap of a person or lady. While setting the handbag or purse on the table or in one's lap may be far safer, etc., than putting it on the floor, both of these places for storage are often essentially impractical and often uncomfortable, at least in the lap position. The device should keep the handbag or purse within sight and easy reach when one or a lady is seated at a table or desk.

In order to meet the problems set forth above, the subject invention has been developed with two devices, one slightly more versatile than the other, being provided, which devices meet the requirements of a safe, adequate, convenient and reasonably priced purse and handbag hanger.

THE PRIOR ART

Applicant is aware of the following U.S. issued patents directed to the specific subject matter of this invention, specifically, devices for supporting, holding and suspending purses and hand bags, particularly with respect to table surface edges.

Yon Schroeder U.S. Pat. No. 2,064,133 "Hanger For Handbags and the Like" issued Dec. 15, 1936;

Meyers Des. U.S. Pat. No. 159,834 issued Aug. 22, 1950 for "Combined Glove Holder and Handbag Support";

Church U.S. Pat. No. 2,565,719 "Support For Handbags and Other Articles" issued Aug. 28, 1951;

Zezula U.S. Pat. No. 3,376,006 "Suspension Clamp Device" issued Apr. 2, 1968;

Berardinelli, et al U.S. Pat. No. 3,860,210, issued Jan. 14, 1975 for "Handbag Holder";

Serkez U.S. Pat. No. 4,118,001, issued Oct. 3, 1978 for "Handbag Holder";

Schultz U.S. Pat. No. 4,194,714, issued Mar. 25, 1984 "Foldable Purse Hanger and Whistle";

Dockery Des. U.S. Pat. No. 256,738, issued Sept. 9, 1980 for "Purse Holding Hook"; and Burke et al, Des. U.S. Pat. No. 297,074 issued Aug. 9, 1988 for "Purse Holder".

Applicant is further aware of the following Coat Hook and Garment Hanger patents:

White U.S. Pat. No. 1,132,414 issued Mar. 16, 1915 for "Coat Hook";

Franck U.S. Pat. No. 1,751,198 "Garment Hanger" issued Mar. 18, 1930; and

Yalli Des. U.S. Pat. No. 263,779 issued Apr. 13, 1982 for "Coat Hook."

OBJECTS OF THE INVENTION

A first object of the invention is to provide a new and improved purse and handbag hanger and support for use when the handbag or purse owner or user is seated at or near a table or desk or a like support.

Another object of the subject invention is to provide such a purse and handbag support and holder wherein, due to the inherent nature of the support and its structure, a handbag or purse may be able to be positioned, optionally, either substantially perpendicular to or substantially parallel with the edge of a table or desk on which the support is used.

Another object of the invention is to provide such a purse and handbag support for use at a table or desk wherein, where there is an overhang of the edge on which the support is used and where the purse or handbag is oriented perpendicular to the said edge, it is considerably out of the way of contact from someone passing near the edge of the desk and, in the other case, where it is suspended parallel to the edge of said table or desk, it is entirely or substantially entirely positioned under the overhanging edge out of harms way.

Another object of the invention is to provide a purse and handbag suspension device wherein both one and two strap handbags and purses may be hung from either of the two optional support points provided by the device.

Another object of the invention is to provide a device of the character described where, when out of use, the hanger or support can be carried in or out of the purse by a chain attached to the one strap of a single strap purse, etc., or one portion of one of the two straps of a two strap handbag or purse.

Yet another object of the invention is to provide one form of the subject device wherein all the parts of the device are rigid per se and with respect to one another, whereby the presence of such two rigid support portions allow one or more handbags or purses to be supported with a minimum of swiveling in the device when the handbag and/or the device itself are bumped or disturbed.

Still another object of the invention is to provide at least one type of holder to effectively support a handbag or purse from a table or desk where the table top or desk top and the walls at the side and edges thereof have little or no indentation or overhang with respect to one another.

Yet another object of the invention is to provide a C-shaped body for a purse hanger or support which carries a hook thereon of limited pivotability, a first use of such pivotability being to make the device easier to carry and less obtrusive, a second use of the pivotability being to provide optional right-angle supportability of a purse or handbag by its carrying strap, a third object of the pivotability being to clear the top portion of the device for engaging a table or desktop without considerable overhang, and a still further object of the pivotibility being to enable the capture and enclosure of the strap of the purse while it is being held.

The main object of providing a pivotable hook is that the straps of a purse can be placed on the hook and the purse can be positioned to any position relative to the table edge by simply turning or rotating the pivotable hook and suspended purse combination.

Other and further objects of the invention will appear in the course of the following description thereof.

DESCRIPTION OF THE DRAWINGS

In the drawings, which a form of part of the instant specification and are to be read in conjunction therewith, embodiments of the inventions are shown and, in the various views, like numerals are used to indicate like parts.

FIG. 1 is a three-quarter perspective view from above of a first form or modification of the invention showing such removably engaged with a tabletop edge or desk edge with a handbag or purse engaged with the lower hook of the subject device.

FIG. 2 is a side view of the device of FIG. 1 shown engaged in full lines with a desk or tabletop having an edge overhang and in dotted lines with a desktop or tabletop where there is no overhang of the top surface portion of the desk or table.

FIG. 3 is a top view of the device of FIGS. 1 and 2 with the full depth engagement of a table or desktop with overhang top edge indicated in dotted lines.

FIG. 4 is a frontal view of the device of the previous figures.

FIG. 5 is a view taken along the line 5-5 of FIG. 2 in the direction of the arrows.

FIG. 6 is a three-quarter perspective view of the device from the rear (outer side), one side and below, with the pivotable lower most hook or member pivoted to the closed position, specifically, where the free end thereof is under the base of the support.

FIG. 7 is a side view of the device of FIG. 6 with portions of the lower part of the upper C-member and the upper part of the lower-C member being cut away to show the pivotable mounting of the lower hook, member or C-member. A table or desk upper surface outer edge is also shown in dotted lines in a position to support the device.

FIG. 8 is a view taken from the front of the device with the open end of the lower pivotal member turned to the left in the view.

FIG. 9 is a view like that of FIG. 8, but with the pivotable member oriented in the opposite direction.

STRUCTURE AND FUNCTION

Figure 1:
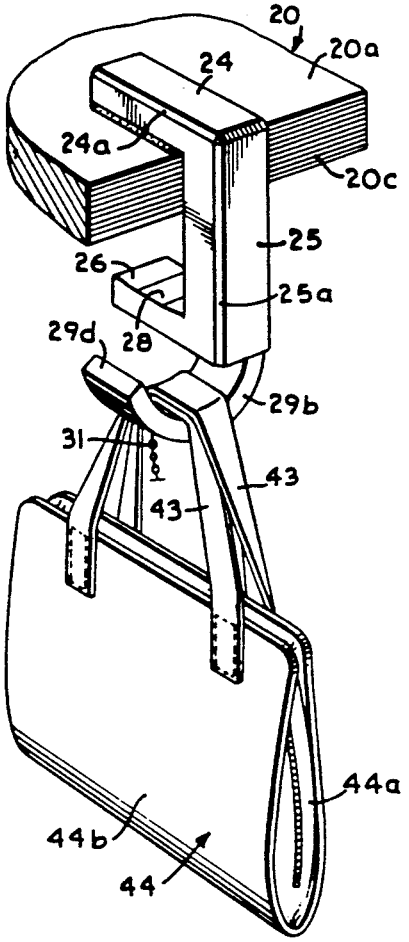
FIGS. 1-5 inclusive, on the first sheet of drawings show a first form or modification of the invention wherein the lower hook of the invention is rigidly fixed with respect to the upper portion of the inventive structure.
Figure 2:
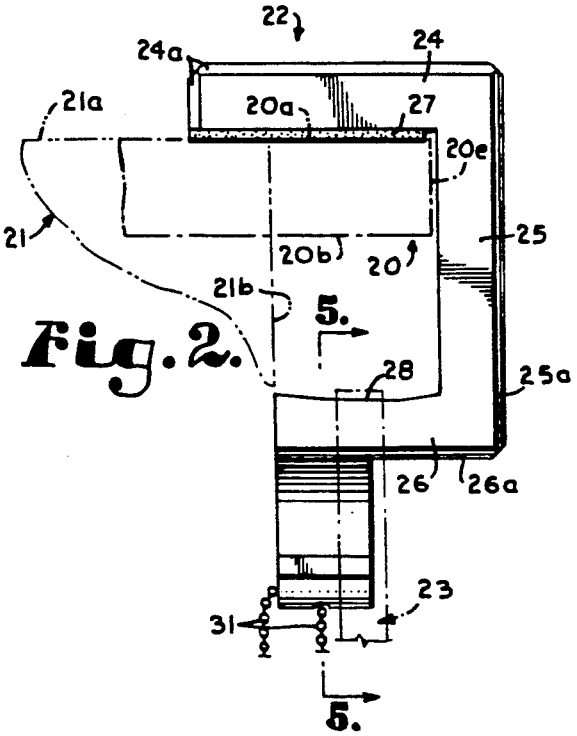
Figure 3:
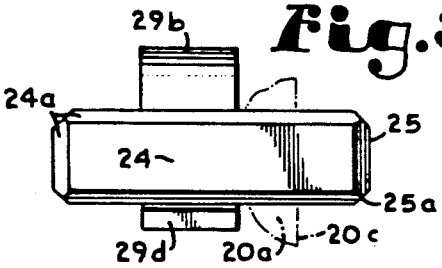

Referring first to FIGS. 1-5, inclusive, wherein the first form or variation of the subject invention is seen, at 20 is seen, in FIGS. 1 and 2, the extending edge of a table or desk which has a top surface 20*a*, a bottom or under surface 20*b* and an outer edge 20*c*. It should be understood that extended desk or table edge portion 20 can be anywhere around the periphery of a table, desk or the like, the table, desk or other support optionally being square, rectangular, oval, circular etc.

In FIG. 2, there is also schematically shown, at 21, the top and side of a table, desk or other support, the top being indicated at 21*a* and the side at 21*b*. The purpose of showing the two diffent forms of desk, table or other support side is to show how the device adapts to a table, etc., top 20 with an overhang and a table, etc top and side 21 without an overhang.

The device of FIGS. 1-5, inclusive basically comprises an upper C-shaped member 22 and a lower C-shaped member or hook generally designated 23. Member 22 has a generally normally horizontal upper leg 24 connecting at one outer end to a normally vertical leg 25, the latter connecting to the outer end of a lower, normally horizontal leg 26. Legs 24 and 26 are preferably parallel with one another, normally horizontal as stated and seen in FIGS. 1 and 2 and at right angles to vertical leg 25. Leg 24 is most preferably substantially longer than leg 26 for a purpose that may be seen in FIG. 2 and will be described. For purposes of looks, members 24, 25 and 26 may be beveled on their upper, inner, outer and lower edges, respectively, such beveling also aiding in comfort of handling and durability of the edges. The beveling is seen at 24*a*, 25*a* and 26*a*.

A length 27 of anti-skid material such as rubber or the like is preferably fixed to the underside of upper leg 24 substantially the longitudinal axis thereof. The upper surface of leg 26 preferably has V-shaped bevel 28 therein running at right angles to the length of leg 26, to conveniently hold the straps of a purse when the straps are placed on the top of member 26.

Typical, but not limiting dimemsions with respect to a C-shaped member 22 as seen in the views could involve the width of members 24, 25 and 26 being ¾ of an inch. The height or depth (thickness) of members 24, 25 and 26 (save for the V notch in 26) could be approximately 7/16 inch. The length, end to end, of leg or member 24 could be 2 and ½ inches. The length, end to end, of leg 25 could 3 and ⅛ inches. The length, end to end, of leg 26 could be 1 and ⅞ inches.

Speaking further with respect to the noted typical, but not limiting demensions just noted, a difference in length between top leg 24 and bottom leg 26 of the top C-member or configuration, a greater length of leg 24 of ⅝ inches probably is about the minimum for a workable device. Thus, upper leg 24, from end to end, within the scale of demensions being discussed, best should have a length of from 2 and ½ to 3 inches. The vertical length, end to end, of leg 25 may typically best vary from 3 and ⅛ to 4 and ⅛ inches. With these given demensions, and assuming the length, end to end, of leg or member 24 being approximately 2 and ½ inches, all of the features of the hanger may be utilized on a table or maximum thickness ranging from 2 to 3 inches. However, a handbag who s straps are placed on top of leg 26 in recess 28 or the equivalent position in FIGS. 6–9, inclusive, may be supported by a table of greater thickness.

Figure 4:
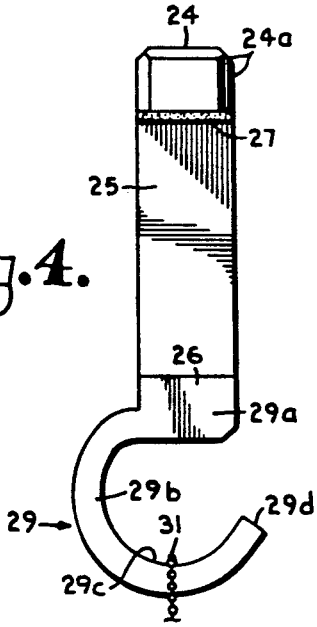
Figure 5:
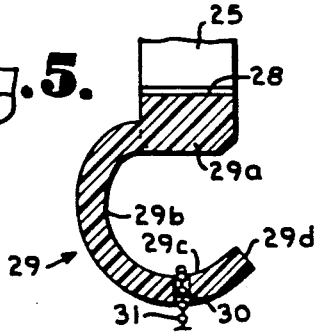

Looking at the lower portion of the device, and particularly at FIGS. 4 and 5, there is provided a C-shaped device (if the lower part of leg 26 continuous with the hook (integral) or connected thereto is considered).

FIGS. 6–9 INCLUSIVE

Referring to FIGS. 6–9, inclusive, therein is shown a structural variation, with some functional variations, of the device of FIGS. 1–5, inclusive. Essentially, the devices of the two sets of figures are identical, except for differences in the lower C-member or lower hook. Accordingly, all the parts of the upper C-member which are the same or substantially the same as the like parts of the upper C-member in FIGS. 1–5, inclusive are numbered the same, but primed. These parts will not be here redescribed, except insofar as they differ or optionally differ from the corresponding parts in FIGS. 1–5, inclusive.

Figure 6:
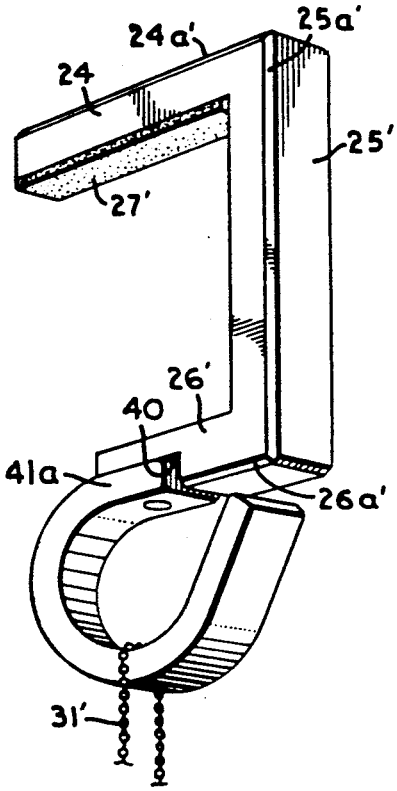
FIGS. 6-9 inclusive are drawing figures directed to second modification of the subject device.
Figure 7:
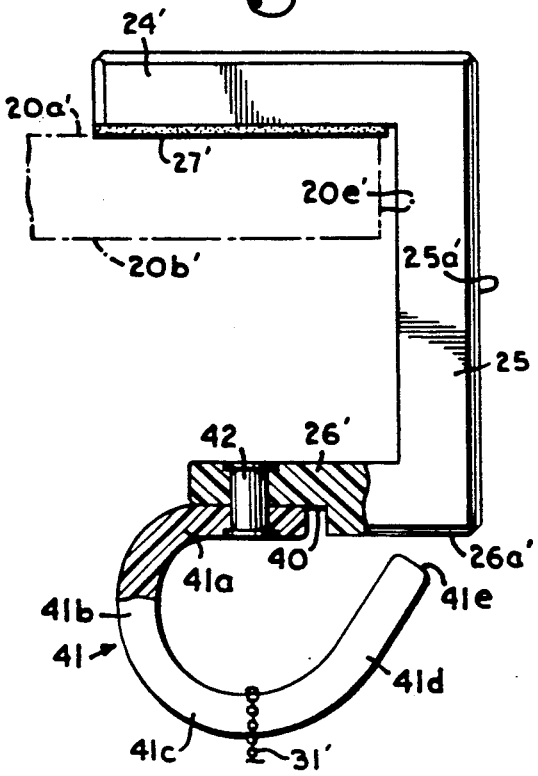

Before getting into a detailed description of the variant device of FIGS. 6–9, inclusive with the pivotable hook 41 as opposed to the fixed hook 29 of FIGS. 1–4, inclusive, attention is drawn to FIGS. 6 and 7. In these views, it may be seen that the closed portion of hook 41 extends to the left of the end of leg 26' in the views of FIGS. 6 and 7, to equal the extension of leg 24'. This would prevent or hinder the optional use of the device in the situation seen in FIG. 2 with a downwardly extending table or support edge **21*b*, against which the end of leg 26 would rest. In order to permit such use, the end of leg 24' of FIGS. 6–9, inclusive and most particularly as seen in FIGS. 6 and 7 may be extended in length to the left in those views from ½ inch to 1 inch to even a maximum of 1 and ½ inches, whereby the function described and seen with respect to FIG. 2 and table or support portion 21, 21*a* and 21*b*** would be fully and entirely recovered.

As may be seen in FIGS. 6 and 7 particularly, the underside of the forward free end of bottom leg 26 prime of the upper C-member is relieved at 40 to provide, on the underside of said leg a recess preferably having an upper, normally horizontal wall and an outer, normally vertical wall. There is provided a curved hook or somewhat C-shaped member generally designated 41 having an upper free end portion **41*a* which is preferably flattened and somewhat rectangular in at least a portion of the length thereof adapted to fit into recess and relief 40. A rivet or connector 42 serves to pivotally yet frictionally connect portion 41*a* with the forward portion of leg 26' in relief or recess 40. This connection provides enough friction to keep hook 41 in position relative to upper C-member 24, after adjustment, under most circumstances. Member 41 also has curved but generally vertical midportion 41*b*, lower, curved but generally horizontal portion 41*c*, outer generally staightening portion 41*d*, the latter having free end 41*e*. If desired, the near end portion 41*d* can be removed from member 41 so that the hook member 41 resembles and has a configuration like that of member 29 in FIGS. 1–5, inclusive. The elongated member 41 end 41*d*** is here shown to provide an additional feature as an option with respect to the structure.

OPERATION

In describing the operation of the devices previously described, it should be understood that, in seating arrangements, at small tables, large tables such as banquet tables, square, rectangular and round tables, tables with edge overhang and not and desks and other supports with the same characteristics, a large number of possibilities of seating place and arrangement (or even standing position) can occur. The person using the subject device or devices is not able to choose, in most cases, the circumstances and structural features of the table, desk or other support at which she/he may be seated, sit or stand. It therefore becomes necessary to provide a device where the purse, handbag or strap supported object or container which accompanies the user can be oriented in at least two and preferably more ways with respect to the edge of the table and the legs of the bag/-purse/container owner when the latter is seated.

The device of FIGS. 1–5, inclusive shows the two most important and basic orientations possible with respect to a given support, table or desk. Thus, in FIG. 1, the top C-member is engaged (by the top leg 24 thereof, with a table or desktop edge with leg 24 typically extending inwardly of the table, desk or other support top, surface normal to the peripheral edge thereof which is engaged by the device. It will be recalled that the device of FIGS. 1–5, inclusive has rigid parts, that is, the upper C-member 22 and the lower C-member 23 are fixedly positioned at right angles to one another.

In FIG. 1, the straps 43 of a typical rectangular side view purse 44 are received over the lower C-member or hook 23 in portion **29*c* thereof. This is a very common shape purse where, in end view, say from end 44*a*, the purse is relatively slim. On the other hand, looking at purse 44 from the side view thereof on side 44*b*** for example, the purse is of considerable large rectangular area, here somewhat longer than higher.

In mounting a purse of this kind, various factors may have to be taken into consideration. Thus, if the purse owner is seated closely next to someone, then the purse would be mounted as seen in FIG. 1. This would give the least obstruction between the two seated persons. On the other hand, in the event the purse owner is not seated closely next to someone and there is plenty of space next to her/him, then the purse straps 43 might be mounted over leg 26 as is seen in dotted lines in FIG. 2. This takes up the maximum lateral space, but puts the purse more under the table/desk/support outwardly extending surface. It should thus be noted that when there is an overhang of the table/desk/support periphery, the purse or handbag may be mounted on either of the "hooks" (upper and lower C-members), depending on the circumtances. The shape and size of the handbag/purse/strap carried container will effect selection also. Thus, a cylindrical, cubical or round bag type purse, to mention some other common shapes, very well may make it irrelevant as to which hook is employed with respect to a person sitting next to the user or there being free space. Either hook may thus be chosen with esentially no change in results.

This brings us to the showing of FIG. 2 where the non-overhang or non-edge extension desk, table or support 21 is encountered. There may be no overhang at all from the top of the desk, etc to the floor or an overhang which is of greater height or thickness than the vertical distance between legs 24 and 26. The reason that legs 24 and 26 are substantially spaced from one another is to acommodate a good range of overhang thicknesses. Also to give clearance under a fairly thick overhang to hang the straps 43 on the leg 26.

At any rate, in the instance where the overhang blocks the lower hook 23, then this option cannot be used. This is not the case with the upper C-member 22 as seen in FIG. 2. That is, with an overhang or lack of overhang as seen as at 21*b*, the front of leg 26 is going to abut wall 21*b*. In this case, the straps of the purse are first hung over leg 26 and then the device is engaged with the top surface of the desk or table or support with the free end extension of top leg 24 of top C-member 22. The purse straps may not be disengaged thereafter until the device is disengaged from the table, etc.

As previously partly discussed, the subject device, either variation, may be carried in a number of ways. First, it may just be carried in a purse, handbag or strap-mounted container, per se. Secondly, it may be removably engaged by the hadbag owner with the straps of the purse after the purse is closed and hang outside of the purse as it is carried along. Finally, in the type of purse where there is no full top closure of the interior of the purse, the chain 31 may be engaged with one or more of the straps and the device hang down into the interior of the purse or handbag.

Figure 8:
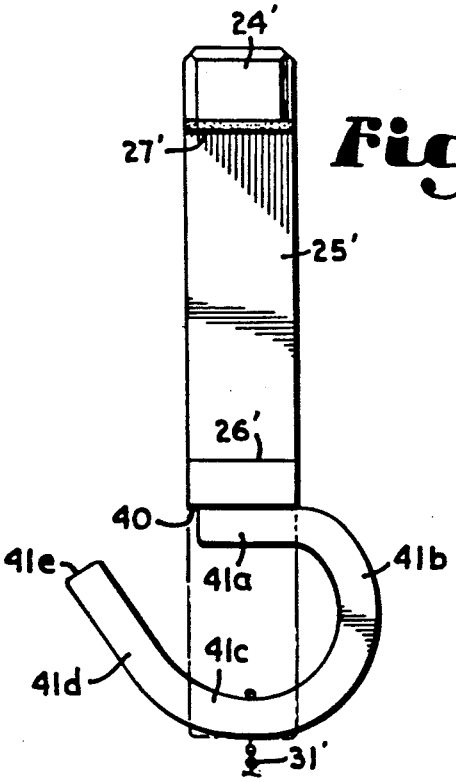
Figure 9:
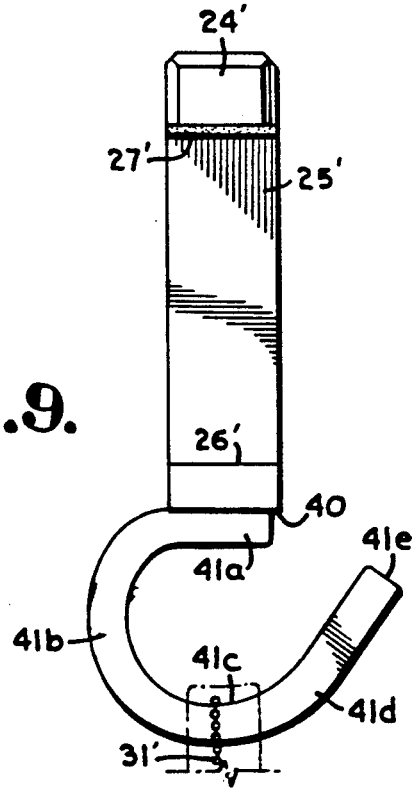

Looking at the device of FIGS. 6–9, inclusive, the L remarks previously made with respect to the device of FIGS. 1–5, inclusive all apply where the lower C-member 41 or hook 41 is at right angles to the upper C-member as seen in FIGS. 8 and 9. However, there is the extra dimension in FIGS. 8 and 9 of having the opening of the lower C-member or hook 41 open to one side or the other, as desired. This is important when one has to sit on one side or the other of the device as it engages the table.

Yet further, there is the feature as seen in FIGS. 6 and 7, specifically, where the open end 41*e* of lower hook member or C-member 41 is reversed outwardly under lower bar 26′ and/or vertical bar member 25′. The effect that is achieved here is that, once the purse straps have been engaged with portion 41*c* of C-member 41, the member 41 may be rotated around pin 42 from a position as seen in FIG. 8 or FIG. 9 to the position seen in FIGS. 6 and 7, effectively closing off the lower hook. To disengage the purse straps, there must be a rotation 90 degrees (or at least 45 degrees) to disengage the purse straps from the positions of FIGS. 6 and 7.

There are two additional options from the three positions seen in FIGS. 6 and 7, FIG. 8 and FIG. 9. This is the intermediate, 45 degree angle position of the hook member 41 with respect to lower leg 26′ on each side of leg 26′. This option gives a different angle of suspension of a purse or handbag from the lower C-member or hook with respect to the upper portion of the device and thus more versatility.

It should also be noted that the position of FIGS. 6 and 7 for the lower C-member or hook is that position where the lower C-member or hook preferably is when for some very unusual reason the handbag straps are placed over the lower leg. This means that the lower C-member is out of the way of the straps as they hang from the lower leg 26′ support which is not entirely the case in the device of FIGS. 1–5, inclusive, as may be seen in FIGS. 4 and 5.

It should particularly be noted that it is not necessary to place the straps of a handbag on leg 26′ when you have a pivotable lower hook 40. A prime advantage of the pivotable hook is that the straps of a purse can be placed on the hook, then the purse can be positioned to hang in any of several positions by simply turning the pivotable hook and purse together. This device thus contrasts with the first form of the device seen in FIGS. 1–5, inclusive where one must make a mental decision where to place the straps of a purse on the device for the mounting desired.

From the foregoing, it will be seen that this invention is well adapted to teach all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A hanger for a purse or the like comprising a first, elongate, upper, normally horizontal, first arm with inboard and outboard ends thereof, a second, elongate, intermediate, normally vertical second arm having upper and lower ends thereof, the upper end thereof fixedly connected to the outboard end of the upper arm, a third, lower, normally horizontal third arm also having inboard and outboard ends thereof with the outboard end thereof fixedly connected to the lower end of the second arm, the third arm shorter than the first arm so that the inboard end of the latter extends inboard beyond the inboard end of the former, the third arm having normally substantially horizontally extending upper and undersides thereto, and a C-shaped hook member pivotably fixed at one upper end thereof to the underside of said third arm adjacent the inboard end thereof, said C-shaped hook member, in at least the lower portion thereof, extending below said third arm underside and removably positionable at a variety of angular positions with respect to said third arm including parallel and at opposite right angles thereto, a recess in the inboard end of said third arm in the underside thereof, the upper portion of said C-shaped hook member pivotably fixed to said third arm being positioned within said recess, and the outboard end of said recess limiting the ability of said C-shaped hook member to pivot with respect to said third arm in the neighborhood of an arc slightly greater than 180 degrees.

2. A device as in claim 1 wherein said C-shaped hook member has an extended free end whereby, when said hook member is so positioned as to be substantially parallel with and under said third arm, the free end thereof approaches at least one of the lower end of the second arm or the outboard end of the third arm.

* * * * *